US005460694A

United States Patent [19]

Schapira et al.

[11] Patent Number: 5,460,694

[45] Date of Patent: Oct. 24, 1995

[54] PROCESS FOR THE TREATMENT OF ALUMINUM BASED SUBSTRATES FOR THE PURPOSE OF ANODIC OXIDATION, BATH USED IN SAID PROCESS AND CONCENTRATE TO PREPARE THE BATH

[75] Inventors: Joseph Schapira, Paris; Patrick Droniou, Colombes; Patrice Pelletier, Deuil la Barre; Stéphane Gagnepain, Saint Ouen, all of France

[73] Assignee: C.F.P.I., Gennevilliers, France

[21] Appl. No.: 77,611

[22] Filed: Jun. 17, 1993

[30] Foreign Application Priority Data

Jun. 17, 1992 [FR] France ..... 92 07352

[51] Int. Cl.[6] ..... C23F 1/00

[52] U.S. Cl. ..... 216/104; 156/665; 252/79.3; 252/79.4; 134/3; 134/41

[58] Field of Search ..... 156/665, 651; 252/79.3, 79.5; 134/3, 41; 204/32.1, 33

[56] References Cited

U.S. PATENT DOCUMENTS

| | | | |
|---|---|---|---|
| 3,943,039 | 3/1976 | Wittrock | 204/42 |
| 4,076,779 | 2/1978 | Skriletz | 134/3 X |
| 4,148,670 | 4/1979 | Kelly | 148/6.15 R |
| 4,338,140 | 7/1982 | Reghi | 148/6.14 R |
| 4,502,925 | 3/1985 | Walls | 204/129.75 |
| 4,784,731 | 11/1988 | Higuchi et al. | 204/27 |
| 4,857,211 | 8/1989 | Nineuil et al. | 134/3 X |
| 4,992,116 | 2/1991 | Hallman | 148/247 |
| 4,994,121 | 2/1991 | Sobata et al. | 148/251 |
| 5,030,323 | 7/1991 | Awad | 156/665 |
| 5,139,586 | 8/1992 | Das | 148/246 |
| 5,227,016 | 7/1993 | Carlson et al. | 252/79.3 X |

FOREIGN PATENT DOCUMENTS

| | | |
|---|---|---|
| 0104821 | 9/1983 | European Pat. Off. . |

*Primary Examiner*—Thi Dang
*Attorney, Agent, or Firm*—Larson and Taylor

[57] ABSTRACT

Process for the treatment of aluminum based substrates for the purpose of their anodic oxidation, comprising a surface treatment or chemical etching step using an acid bath comprising at least one fluorinated derivative of titanium and/or of zirconium and/or of silicium as well as at least one acid of the group comprising $NO_3H$, $SO_4H_2$ and phosphoric acid.

5 Claims, No Drawings

PROCESS FOR THE TREATMENT OF ALUMINUM BASED SUBSTRATES FOR THE PURPOSE OF ANODIC OXIDATION, BATH USED IN SAID PROCESS AND CONCENTRATE TO PREPARE THE BATH

The invention relates to a process for the treatment of aluminum based substrates for the purpose of their anodic oxidation.

It also relates to a bath used in the said process as well as to a concentrate for the preparation of the bath.

The substrates, i.e. the aluminum based elements and sections or profiles, in other words the elements and sections or profiles made of aluminum or one of its alloys, are used in the industry and especially for architectural uses, particularly for the manufacture of door or window frames.

In order to protect these elements during their use, the said elements and sections can be painted or subjected to an anodic oxidation treatment in acid medium.

At the end of said treatment, the said elements and sections are protected by an artificially obtained $Al_2O_3$ oxide coating; depending from the requested degree of protection which is a function of the use of the elements inside or outside, the coating of alumina can be more or less thick; its thickness is generally comprised between 2 and 30 micrometers.

The anodic oxidation constitutes one of the steps of a sequence comprising generally:

- a degreasing step generally in alkaline medium intended to eliminate organic smudges or smears, being however noticed that sometimes the degreasing step is carried out using phosphoric acid,
- a cold tap water rinsing step,
- a step consisting of a chemical surface treatment, also called chemical etching, intended to eliminate the superficial imperfections of the elements and to provide the aluminum with a generally non-glossy aspect,
- one or several cold water rinsing steps,
- a step consisting of an acid bleaching generally using $HNO_3$,
- one or several cold water rinsing steps,
- the anodic oxidation itself, often carried out when architectural uses are contemplated by way of a solution based on sulphuric acid,
- one or several rinsing steps first with tap water and then with demineralized water,
- a so-called scaling step to close the pores originating from the anodic oxidation.

The features which are characteristic of the protection provided to the aluminum based substrates essentially depend of the anodic oxidation and the following steps; on the contrary, the look or aspect of the substrates depends from the steps which precede the anodic oxidation, the object of these steps being:

- the elimination of the die-marks which appear when extruding the profiles through more or less old extrusion dies,
- the suppression of the crystalline segregation zones, especially in the case of hollow extrusion sections or profiles,
- a reproducible uniform mat appearance at the end of the treatment.

In that respect, the steps proceeding the anodic oxidation comprise the step called chemical etching step by way of which there is obtained a pickling consisting in the elimination of the superficial coating of the substrates; in practice, the thickness of the coating removed by pickling from elements or sections is about 30 micrometers, which corresponds to a weight loss of about 90 $g/m^2$.

In order to carry out the chemical etching step, alkaline baths containing a strong base, NaOH or KOH, have already been used; the thus treated substrate is provided with the expected mat appearance. The brightness of the substrate which corresponds to the degree of the mat appearance obtained and which is measured according to the standard ISO 7668, at 60° C., is comprised between 35 and 70 after the chemical etching step and is comprised between 5 and 13 after the anodic oxidation; the lower is the number obtained when measuring the brightness, the higher is the degree of the mat appearance of the surface.

In order to uniformize the mat appearance of aluminum, it has been proposed to use, in connection with the architectural application, so-called permanent chemical etching baths (excluding any emptying of the tanks of vessels) which reach a balance at high contents in free NaOH (comprised between 80 and 120 g/l) and in aluminum (comprised between 120 and 180 g/l). The temperature of these baths is comprised between 50° and 70° C.; the substrates are immersed in these baths during about 15 to about 25 minutes in function of the requested degree of mat appearance.

In order to keep in solution the concentrated aluminum salts, complexing agents such as gluconate are introduced in the said baths.

In order to increase the degree of mat appearance of the treated elements without increasing the thickness of the coating removed by pickling, it has been proposed to introduce in the chemical etching bath nitrogenous derivatives such as for example nitrates; however, the release of hydrogen which occurs due to the attack of the aluminum:

$$NaOH+Al+H_2O \rightarrow NaAlO_2+3/2\ H_2$$

makes the medium a very reducing one and leads to the production of ammonia starting from the nitrates, in other words to an aerial pollution as well as to a corrosion of the equipments or installations. Consequently, that technique or practice has generally been abandoned.

The protection of the environment commands, on a world wide level, that the aqueous or solid effluent discharges are lower and lower; consequently, attempts are made to recycle the used products and to regenerate them or to upgrade the non-regenerable wastes.

As far as solid effluents are concerned, it becomes more and more difficult to put them in dumping grounds due to the fact that the degree of filling of the latter is higher and higher and it becomes consequently necessary to decrease, in connection with the preparation of the aluminum surfaces before anodic oxidation, the chemical attacks due to the chemical etching in order to decrease by way of consequence the aluminum hydroxide muds which originate from the neutralization of the effluents of the baths.

In order to decrease the quantities of muds, it has been proposed to use baths without organic complexing agents; the advantage of these baths is that they facilitate the precipitation of aluminum hydroxide and consequently the regeneration of the NaOH according to the chemical equation $$AlO_2^-+2H_2O \rightarrow Al(OH)_3+OH$$

the regenerated NaOH being recycled into the chemical etching bath.

But it is then necessary to work with diluted chemical etching baths (about 10 g/l of free NaOH and 12 g/l of aluminum in solution), as it becomes then possible to carry out the reaction of precipitation within an annexe installation; however, the risk of precipitation of $Al(HO)_3$ within the working tank remains important, the consequence being the stopping of the production and the necessity of cleaning of the tank.

It is also been proposed (European Patent Application No. 0 104 821) to carry out the chemical etching step using a bath consisting of a diluted aqueous solution of hexafluophosphoric acid which may contain $NO_3H$.

However, the degree of mat appearance of the thus treated substrates is poor.

Consequently, an object of the invention is to provide a process as well as a bath of the kind in question which no longer present the drawbacks of the prior art and due to which it becomes possible to obtain substrates having an excellent degree of mat appearance.

And the Applicants have had the merit of finding that, surprisingly and unexpectedly, it becomes possible to obtain substrates presenting an excellent degree of mat appearance, without any risk as far as exploitation of the process is concerned, and while diminishing the amount of alkaline wastes (NaOH and aluminate) as well as the thickness of the coating removed by pickling as soon as use is made for the chemical etching step of an acid bath comprising at least one fluorinated derivative of titanium and or of zirconium and/or of silicium as well as at least one acid of the group comprising $NO_3H$, $SO_4H_2$ and phosphoric acid.

Consequently, the process according to the invention for the treatment of aluminum based substrates for the purpose of anodic oxidation is characterized by the fact that it comprises a step consisting of a surface or chemical etching treatment using an acid bath comprising at least one fluorinated derivative of titanium and/or of zirconium and/or of silicium as well as at least one acid of the group comprising $NO_3H$, $SO_4H_2$ and phosphoric acid.

According to an advantageous embodiment of the abovesaid process, the chemical etching step using the acid bath is followed by a complementary light chemical etching step using an alkaline bath, the conditions of this chemical etching being such that it results in the removal by pickling of at least 40 g/m$^2$ of aluminum.

The bath according to the invention for the treatment of aluminum based substrates for the purpose of their anodic oxidation is characterized by the fact that it comprises at least one fluorinated derivative of titanium and/or of zirconium and/or of silicium as well as at least one acid of the group comprising $NO_3H$, $SO_4H_2$ and phosphoric acid.

The concentrate according to the invention which is capable to provide by dilution with water the bath according to the invention may contain the fluorinated derivative of titanium and/or of zirconium and/or of silicium at a concentration, expressed in terms of commercial product, from 50 to 99.5% and the acid of the group comprising $NO_3H$, $SO_4H_2$ and phosphoric acid at a concentration, expressed with respect to the technical product, from 0.5 to 50%.

The acids of the group comprising $NO_3H$, $SO_4H_2$ and phosphoric acid present the advantage of being already present in the anodic oxidation installations of lines within the degreasing acid baths ($H_3PO_4$), within the bleaching baths ($HNO_3$) and within the anodic oxidation baths ($H_2SO_4$); it is furthermore possible to regenerate them starting from the said baths by way of already known processes (ion exchange resins for example); it is also possible to use them directly in the acid pickling bath provided that their degree of pollution allows it, this condition being satisfied in connection with the present invention.

Taking into consideration this possibility of recycling of the acids from the group comprising nitric, sulphuric and phosphoric acids, a concentrate according to the invention proper to lead to the bath according to the invention after dilution with water and with recycled acid can comprise, besides the water, a fluorinated derivative of titanium and/or of zirconium and/or of silicium at a concentration, expressed with respect to the technical product, comprised between 50 and 99.5%.

Such a concentrate can be diluted with water to a concentration comprised between 1 per thousand and 10% in order to lead to the bath ready to use.

According to an embodiment of the chemical etching bath according to the invention used in the method according to the invention, the fluorinated derivative of titanium, of zirconium or of silicium is selected from the group comprising the fluometallic acids $H_2TiF_6$, $H_2ZrF_6$, $H_2SiF_6$, as well as their alkaline or ammonium salts.

According to another advantageous embodiment, the pickling bath according to the invention comprises the fluorinated derivative of titanium and/or of zirconium and/or of silicium at a concentration of at least 1 g/l, and the nitric and/or sulphuric and/or phosphoric acid at a concentration comprised between 0.5 and 100 ml per liter of bath, expressed in concentrated technical acid.

The abovesaid concentrations as well as the duration and the temperature of the chemical etching step are selected in order to obtain on the substrate a pickling rate of at least 5 g/m$^2$.

In order to optimize the degreasing step or even possibly to suppress the degreasing step, it is possible to add to the chemical etching bath or to the concentrate nonionic, anionic or cationic surfactive agents and co-solvents.

It is possible to select the abovesaid surfactive agents from the group comprising alkylphenols, alcohols and polyalkoxylated amines, alkyl-, alkylaryl- and arylsulphates, sulphonates, phosphates and quaternary ammoniums.

The co-solvents can consist, for example, of glycols.

The temperature of the chemical etching bath is comprised between 15° C. and 80° C. and preferably between 20° and 60° C.

The duration during which the action of the bath is maintained, duration which depends of the concentration and of the temperature and which must be sufficient to lead to a pickling of at least 5 g/m$^2$, is comprised between 1 minute and 1 hour. For sake of productivity, the duration of the treatment, industrially speaking, will not exceed preferably about thirty minutes.

Advantageously, the treatment comprises, after the acid pickling according to the invention, a complementary alkaline light pickling carried out according to a process known by itself and which is such that it provides a pickling of at most 40 g/m$^2$ of aluminum; for instance, it is possible to use a bath whose temperature is comprised between 40° and 70° C. and which contains, on the one hand, between 10 and 180 g/l of aluminum (i.e. between 30 and 550 g/l of sodium aluminate), on the other hand, between 10 and 150 g/l of free NaOH and, on the other hand again, possibly, adjuvants used in order to keep the aluminum in solution when it is present in high contents, the said adjuvants being for example organic complexing agents such as gluconate and sorbitol.

It is possible to use as gluconate based adjuvant the product commercialized by the Applicants under the trademark PROGAL G 313 TA.

The thus obtained alkaline pickling bath is used during 2 to 20 minutes on elements leaving the acid pickling bath.

The invention will still be better comprised by way of the following non limiting examples in which are disclosed advantageous embodiments of the invention.

EXAMPLE 1

Extruded profiles consisting of aluminum, reference 6063 according to the standard ISO 209, are subjected to the following treatment:

Step 1: degreasing in caustic soda containing water within an aqueous solution containing 100 g/l of IPRO 77 AP commercialized by the Applicants, Step 2: Rinsing with cold tap water, Step 3: Acid pickling (chemical etching) (cf. the 8 comparative experiences whose characteristics appear from Table I), Step 4: Rinsing with cold tap water, Step 5: Alkaline pickling (chemical etching) using a bath whose characteristics are given hereafter, Step 6: Rinsing with cold tap water, Step 7: Nitric bleaching within a bath containing 180 g/l of concentrated nitric acid in water, Step 8: Rinsing with cold tap water, Step 9: Anodic sulphuric oxidation within a bath containing 180 g/l of concentrated sulphuric acid (temperature 18° C.), Step 10: Rinsing with cold tap water, Step 11: Rinsing with demineralized water, Step 12: Sealing with hot demineralized water (98° C.).

TABLE I

| | Chemical composition of the pickling baths | |
|---|---|---|
| Bath N° | Fluorinated product | Complementary acid |
| b1 | $H_2TiF_6$ at 60%: 40 g/l | $H_2SO_4$ at 98% = 3 ml |
| b2 | $H_2ZrF_6$ at 45%: 68 g/l | $H_2SO_4$ at 98% = 3 ml |
| b3 | $H_2SiF_6$ at 34%: 63 g/l | $H_2SO_4$ at 98% = 3 ml |
| b4 | HF at 50%: 35.5 g/l | $H_2SO_4$ at 98% = 3 ml |
| b5 | $HPF_6$ at 60%: 36 g/l | $H_2SO_4$ at 98% = 3 ml |
| b6 | $HBF_4$ at 50%: 26 g/l | $H_2SO_4$ at 98% = 3 ml |
| b7 and b8 | Pure water | — |

The temperature of the acid pickling bath is 30° C.

The duration of the treatment is selected in order to obtain a pickling of about 25 g/m$^2$.

Eight comparative experiences were carried out using successively the bath b1 to b8.

In step 5 there is used a chemical etching bath which is permanent and whose characteristics are:

free NaOH: about 100 g/l aluminum: about 140 g/l temperature: 60° C.

The duration of the treatment within this bath, the acid pickling baths being those called b1 to b6, is the one which is necessary to obtain a pickling rate of about 25 g/m$^2$.

This duration is not used in connection with the control experiences using the baths b7 and b8:

in connection with the experience using bath b7, the alkaline bath of step 5 is used during a time which is sufficient to obtain a pickling of about 50 g/m$^2$, which is comparable with the total running of the acid and the alkaline picklings of experiences 1 to 6, and in connection with the experience using bath b8, the process used is the one presently used on the installations of anodic oxidation of aluminum, i.e. a classical alkaline chemical etching of about 18 to 20 minutes, which provides a pickling of about 80 to 90 g/m$^2$ of aluminum.

The recorded results are collected in Table II.

TABLE II

| Exp. No. | Acid pickling rate | Alkaline chemical etching rate | Global pickling rate | Brightness after step 8 | Observation |
|---|---|---|---|---|---|
| 1 | 24 g/m$^2$ | 16 g/m$^2$ | 40 g/m$^2$ | 18 | Aspect of aluminum is correct |
| 2 | 30 g/m$^2$ | 17 g/m$^2$ | 47 g/m$^2$ | 28 | Blackish deposit after chemical pre-etching which is eliminated during the alkaline step |
| 3 | 19 g/m$^2$ | 23 g/m$^2$ | 42 g/m$^2$ | 36 | Aspect of aluminum is correct |
| 4 | 26 g/m$^2$ | 20 g/m$^2$ | 46 g/m$^2$ | 68 | Aspect of aluminum is correct |
| 5 | 22 g/m$^2$ | 21 g/m$^2$ | 43 g/m$^2$ | 56 | Blackish deposit after chemical pre-etching which is eliminated during the alkaline step |
| 6 | 20 g/m$^2$ | 21 g/m$^2$ | 41 g/m$^2$ | 30 | Aspect of aluminum is correct |
| 7 | — | 51 g/m$^2$ | 59 g/m$^2$ | 53 | Control having a comparable pickling rate |
| 8 | — | 86 g/m$^2$ | 86 g/m$^2$ | 40 | Normal presently used process |

It is well-known and this point is confirmed by the experiences using the baths b7 and b8, that it is sufficient to increase the pickling rate in the alkaline chemical etching bath in order to decrease the brightness.

It appears from Table II that, when the global pickling rate is comprised between 40 and 50 g/m$^2$, this pickling rate having been obtained by use of a bath according to the invention followed by the use of a classical alkaline chemical etching bath, the brightness measured according to the standard ISO 7668 (at 60° C.) on extruded sections after bleaching is lower than the one obtained in the experience using bath b8 (prior art) for classical pickling rates of about 80–90 g/m$^2$. The aspect of the elements obtained using the process according to the invention is comparable and even better than the aspect of the elements obtained with only the alkaline process, the global pickling rate being lower by a half. The experience in which the bath on the basis of $HBF_4$ (b6) is used, which also provides a better brightness must be moved away for the reason that it necessitates a duration which is not compatible with an industrial use, this time being higher than 1 hour and 10 minutes while, in any of the experiences carried out using baths b1 to b5, the elements were immersed during at most 40 minutes in the acid pickling bath.

The baths based on HF (b4) and $HPF_6$ (b5) lead to poor results.

EXAMPLE 2

Extruded profiles consisting of aluminum serial 6063 are subjected to the treatment disclosed in example 1.

As far as step 3 is concerned, baths b1 and b9 to b14 which are defined in Table III are used.

TABLE III

| Bain N° | Chemical composition of the pickling baths: Fluorinated product | Complementary acid |
|---|---|---|
| b1 | $H_2TiF_6$ at 60% = 25 ml/l | $H_2SO_4$ at 98% = 5.4 g/l |
| b9 | $H_2TiF_6$ at 60% = 25 ml/l | HCl at 35% = 11.5 g/l |
| b10 | $H_2TiF_6$ at 60% = 25 ml/l | $HNO_3$ at 60% = 11.5 g/l |
| b11 | $H_2TiF_6$ at 60% = 25 ml/l | $H_3PO_4$ at 75% = 7.2 g/l |
| b12 | $H_2TiF_6$ at 60% = 25 ml/l | oxalic acid = 7.1 g/l |
| b13 | $H_2TiF_6$ at 60% = 25 ml/l | sulfamic acid = 10.7 g/l |
| b14 | $H_2TiF_6$ at 60% = 25 ml/l | citric acid = 10.5 g/l |

The baths b1 and b9 to b14 are used at a temperature of 30° C. during a time which is necessary to provide a weight loss of about 25 g/m$^2$ as far as the treated elements are concerned. These baths are used respectively in the experiences 1 and 9 to 14, the recorded results being indicated in Table IV.

TABLE IV

| Exp. No. | Acid pickling rate | Alkaline chemical etching rate | Global pickling rate | Brightness after step 8 | Observation |
|---|---|---|---|---|---|
| 1 | 24 g/m$^2$ | 16 g/m$^2$ | 40 g/m$^2$ | 18 | |
| 9 | 27 g/m$^2$ | 23 g/m$^2$ | 50 g/m$^2$ | 24 | Pitted by corrosion aspect of the surface of the aluminum |
| 10 | 17 g/m$^2$ | 27 g/m$^2$ | 44 g/m$^2$ | 22 | |
| 11 | 22 g/m$^2$ | 26 g/m$^2$ | 48 g/m$^2$ | 26 | |
| 12 | 30 g/m$^2$ | 27 g/m$^2$ | 57 g/m$^2$ | 47 | |
| 13 | 25 g/m$^2$ | 26 g/m$^2$ | 51 g/m$^2$ | 58 | |
| 14 | 25 g/m$^2$ | 25 g/m$^2$ | 50 g/m$^2$ | 51 | |

The best efficiency is obtained when using the baths based on sulphuric, nitric and phosphoric acids. Hydrochloric acid leads to defects of the aspect.

Organic acids do not provide, during the abovesaid conditions, a sensible improvement of the mat appearance.

EXAMPLE 3

Extruded profiles consisting of aluminum serial 6063 are subjected to the treatment indicated in example 1, step 3 being modified as far as the concentration of potassium fluorotitanate $K_2TiF_6$ is concerned as well as the temperature, the influence of these variations on the pickling speed of the aluminum based elements being examined.

The duration which is necessary to obtain a pickling rate of about 24 g/m$^2$ for each of the concentrations in $K_2TiF_6$ and for each of the selected temperatures has been determined; the concentration in 98% sulphuric acid was 3 ml/l.

The results are recorded in Table V.

TABLE V

| $K_2TiF_6$ | Temperature | Duration which is necessary to obtain pickling rate of about 24 g/m$^2$ |
|---|---|---|
| 0.9 g/l | 30° C. | 400 minutes |
| | 60° C. | 66 minutes |
| | 80° C. | 26 minutes |
| 22 g/l | 20° C. | 29 minutes |
| | 30° C. | 15 minutes |
| | 40° C. | 8 minutes |
| | 60° C. | 3 minutes |
| | 80° C. | 1 minute |
| 57 g/l | 20° C. | 18 minutes |
| | 30° C. | 6 minutes |
| | 60° C. | 1 minute |
| 88 g/l | 20° C. | 6 minutes |
| | 30° C. | 1 minute |

From the examination of Table V, it appears that the pickling speed of the aluminum depends from the concentration in $K_2TiF_6$ and from the temperature. A good compromise for an industrial use of the process according to the invention is obtained by a concentration in $K_2TiF_6$ comprised between 22 and 57 ml/1 and a temperature comprised between 20° and 40° C.

The duration of the treatment is then comprised between six minutes and about thirty minutes, such a duration being compatible with the command of an installation.

EXAMPLE 4

Extruded profiles consisting of aluminum are subjected to a treatment as indicated in example 1, except the steps 5, 6, 7 and 8.

The acid pickling bath (step 3) is consisting of bath b1 disclosed in example 1. The temperature of the said bath is 30° C. and the immersion time is 15 minutes.

The mat appearance of the sections which has been measured after step 4 according to standard ISO 7668 (at 60° C.) is 22; this mat appearance is comparable to the one obtained in the experiences carried out with the baths b1 to b3 of example 1 and is clearly improved with respect to the one obtained in the experiences carried out in the baths b7 and b8 which are control baths and which are disclosed in example 1.

Furthermore, the mat appearance measured according to the same method at the end of step 12 is 5, which means that it is clearly improved with respect to the mat appearance measured under the same conditions in experience 8 of example 1, the latter being industrially at 12–15.

We claim:

1. Process for the treatment of aluminum based substrates comprising a chemical etching step followed by an anodic oxidation step, wherein the chemical etching step is carried out using an acid bath consisting of at least 1 g/l of at least one fluorinated derivative of titanium and/or zirconium and/or silicon, and of at least one acid selected from the group consisting of $HNO_3$, $H_2SO_4$ and phosphoric acid at a concentration comprised between 0.5 and 100 ml per liter of bath, said concentration of said acid being expressed with respect to concentrated technical acid, the temperature of the said acid bath being between 15° C. and 80° C. and the action of the said bath being maintained between 1 minute and one hour, the above said concentrations, the temperature and the duration of action of the bath being adapted such that a pickling rate of at least 5 g/m$^2$ is achieved.

2. Process according to claim 1, wherein the fluorinated derivative is selected from the group consisting of $H_2TiF_6$, $H_2ZrF_6$, $H_2SiF_6$ and their alkaline or ammonium salts.

3. Process according to claim 1, wherein the temperature of the acid bath is between 20° C. and 60° C. and wherein the action of the bath is shorter than thirty minutes.

4. Process for the treatment of aluminum based substrates comprising successively a chemical etching step using an acid bath followed by a chemical etching step using an alkaline bath followed by an anodic oxidation step, wherein said acid bath is consisting of at least 1 g/l of at least one fluorinated derivative of titanium and/or zirconium and/or silicon, and of at least one acid selected from the group consisting of $HNO_3$, $H_2SO_4$ and phosphoric acid at a concentration comprised between 0.5 and 100 ml per liter of bath, said concentration of said acid being expressed with respect to concentrated technical acid, the temperature of the said acid bath being between 15° C. and 80° C. and the action of the said bath being maintained between 1 minute and one hour, the above said concentrations, the temperature and the duration of action of the bath being adapted such that a pickling rate of at least 5 $g/m^2$ is achieved and wherein the conditions of the chemical etching step using said alkaline bath are selected such that it results in the removal by pickling of at most 40 $g/m^2$ of aluminum.

5. Process according to claim 4, wherein said alkaline bath is containing between 30 and 550 g/l of sodium aluminate, between 10 and 150 g/l of free NaOH and complexing agents.

* * * * *